US006237997B1

(12) United States Patent
Olson

(10) Patent No.: US 6,237,997 B1
(45) **Date of Patent: *May 29, 2001**

(54) ERGONOMICALLY INTEGRATED SEAT AND WORK STATION

(75) Inventor: Joshua Olson, Boise, ID (US)

(73) Assignee: Micron Electronics, Inc., Nampa, ID (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/008,749

(22) Filed: Jan. 19, 1998

(51) Int. Cl.[7] ..... A47B 39/00; A47C 13/00
(52) U.S. Cl. ..... 297/162; 297/115
(58) Field of Search ..... 297/115, 161, 297/162

(56) References Cited

U.S. PATENT DOCUMENTS

| | | | | |
|---|---|---|---|---|
| 3,102,754 | | 9/1963 | Junkung . | |
| 3,353,866 | | 11/1967 | Chapman et al. . | |
| 3,367,713 | * | 2/1968 | Krueger | 297/162 |
| 3,408,104 | * | 10/1968 | Raynes | 297/162 |
| 4,685,726 | * | 8/1987 | Wolpert | 297/162 |
| 5,022,706 | * | 6/1991 | Bryan | 297/162 |
| 5,056,864 | | 10/1991 | Cooper . | |
| 5,122,786 | * | 6/1992 | Rader | 297/115 |
| 5,137,384 | | 8/1992 | Spencer et al. . | |
| 5,143,422 | | 9/1992 | Althofer et al. . | |
| 5,292,173 | * | 3/1994 | Lambert | 297/161 |
| 5,311,210 | | 5/1994 | O'Brien et al. . | |
| 5,369,805 | | 12/1994 | Bergsten et al. . | |
| 5,379,973 | | 1/1995 | Rader . | |
| 5,407,249 | | 4/1995 | Bonutti . | |
| 5,612,718 | | 3/1997 | Bryan . | |

* cited by examiner

*Primary Examiner*—Anthony D. Barfield
(74) *Attorney, Agent, or Firm*—Knobbe Martens Olson & Bear LLP

(57) ABSTRACT

An ergonomic work station is disclosed which is comprised of a chair, at least one keyboard section and at least one support assembly. Initially, the support assembly connects the chair to the keyboard section. The support assembly is also movable between a first orientation and a second orientation such that the keyboard section in the first orientation extends outward from the chair in a plane generally parallel to the floor, and the keyboard section in the second orientation extends downward in a plane generally perpendicular to the floor. A method of using an ergonomic work station is also disclosed comprising the acts of positioning at least one keyboard section in a first orientation, wherein the keyboard section is positioned so as to extend generally horizontally outward from a user with the keys facing upwards when a user is using the workstation, and manipulating the keys on the at least one keyboard section. Additionally, the method includes the acts of positioning the at least one keyboard section in a second orientation, wherein the at least one keyboard section is positioned so as to extend generally vertically downward from the torso of the user with the keys facing away from the user, Lastly, and manipulating the keys on the at least one keyboard section.

43 Claims, 4 Drawing Sheets

ERGONOMICALLY INTEGRATED SEAT AND WORK STATION

BACKGROUND OF THE INVENTION

1. Field of the Invention

This invention relates generally to ergonomically integrated work stations. More specifically, the invention relates to an integrated seat and ergonomic keyboard, and a method of using an integrated seat and ergonomic keyboard, wherein at least one keyboard is moveable to at least two positions by an adjustable arm support assembly.

2. Discussion of the Related Art

With the advent of powerful and inexpensive personal computers, a substantial segment of businesses utilize computers. These businesses may include professional services and industrial manufacturers as well as home businesses. In addition, because personal computers are relatively inexpensive and readily available, there has been a proliferation of computers in home environments for personal, educational and entertainment uses. It is very common for individuals in these various settings to spend extended periods of time using computers with computer keyboards. In fact, there are specific employment positions that involve working exclusively on computers using a keyboard to enter data. These include, for example, data processing or data entry positions.

The keyboards most commonly used with personal or office computers are rectangular and flat, and include a plurality of horizontal rows of keys in prearranged positions. To use these keyboards, the user's hands are positioned squarely on the keyboard with the palms facing down. In addition, the user's forearms are either resting flat on the same surface upon which the keyboard rests or, alternatively, suspended in the air while the hands remain positioned squarely on the keyboard.

It is well known that prolonged use of these standard keyboards may cause serious tendon or nerve damage to the user's hands, wrists and forearms. In fact, it is common for long-time users of standard keyboards to develop a medical condition known as carpal tunnel syndrome, which is a debilitating tendon and nerve condition.

To address the problems caused by long term use of standard keyboards, alternative keyboards have been designed. These keyboards, commonly referred to as ergonomic keyboards, are typically designed to conform to the position of a user's hands in a more natural position. That is, such ergonomic keyboards position the placement of keys so as to mimic or correspond to an average person's hands when they are naturally and comfortably at rest on a surface. In order to simulate the hand's natural position, an ergonomic keyboard is typically divided vertically into right and left sections. Then the individual keypads are rotated while still remaining in a horizontal plane. In one ergonomic keyboard device, the left keypad is rotated in a slightly clockwise direction and the right keyboard is rotated in a slightly counter-clockwise direction. As a result, the keypad is positioned in accordance with the "natural" position of a person's hands resting on a surface.

Ergonomic keyboards of this type aid in reducing the risk to users of developing serious nerve and tendon ailments in their hands. However, although these keyboards may improve the positioning of the hands relative the keyboard, they do not improve the positioning of the users' arms and shoulders relative the keyboard. That is, while the hands are positioned naturally on the keyboard, the user's arms and shoulders remain in an unnatural and uncomfortable position. Specifically, the arms extend outward from the torso in a generally horizontal direction. Depending on the height of the surface on which the keyboard sits, the user's arms can remain in a number of unnatural and uncomfortable positions. As with the user's hands and wrists, the arms may suffer serious nerve and tendon damage as a result of prolonged use of common ergonomic keyboards. That is, users remain at risk of developing nerve and tendon damage in the arms and shoulders after prolonged use of both standard and ergonomic keyboards.

Other keyboards have been designed to ergonomically position the keyboard to the user's hands and also to position the keyboard on the user's lap. By placing the keyboard on the lap of the user, the user's arms are not forced to remain unnaturally outstretched for prolonged periods of typing and use. Rather, the user's arms rest more naturally on the lap of the user. However, such keyboards are very cumbersome in that the user is forced to remove or replace the keyboard each time the user desires to rise from or sit in the chair. Such repeated maneuvering is time-consuming, inefficient and inconvenient. Further, a place must be cleared on the surrounding desk or floor to place the apparatus when not in use. In close, space-efficient work environments, such excess space may not be available.

Finally, other keyboard and chair work stations have been designed in which the keyboards are bifurcated and mounted to an extended arm rest assembly. However, this device is not moveable to a second ergonomic typing orientation. Though this device may place the hands in a more natural position, the arms remain extended outward in an unnatural position. The arm rests provide at best only limited support to the arms and shoulders.

Accordingly, there remains a need for a keyboard or typing work station that positions a user's hands in a comfortable, natural position while also maintaining the user's arms and shoulders in a natural and comfortable position.

SUMMARY OF THE INVENTION

The aforementioned needs are satisfied by the ergonomic work station of the present invention which, in one embodiment, is comprised of a chair, at least one keyboard section and at least one support assembly that can be positioned relative a chair or other work station. Initially, the support assembly is connected to the keyboard section and is movable between a first orientation and a second orientation such that the keyboard section in the first orientation extends in a plane generally parallel to the floor, and the keyboard section in the second orientation extends downward in a plane generally perpendicular to the floor.

Another embodiment of the workstation includes a chair comprising a planar seat, a back support, at least one keyboard section and at least one support assembly. The support assembly is engaged with at least one keyboard section and is movable between a first orientation and a second orientation. The support assembly in the first orientation positions the keyboard generally parallel to the floor, and the support assembly in the second orientation positions the keyboard generally perpendicular to the floor.

In yet another embodiment of the invention, a method of using an ergonomic work station is disclosed comprising the acts of positioning at least one keyboard section in a first orientation, wherein the keyboard section is positioned so as to extend generally horizontally outward from a user with the keys facing upwards when a user is using the workstation, and manipulating the keys on the at least one keyboard section. Additionally, the method includes the acts of positioning the at least one keyboard section in a second orientation, wherein the at least one keyboard section is positioned so as to extend generally vertically downward from the torso of the user with the keys facing away from the user, Lastly, and manipulating the keys on the at least one keyboard section.

In another embodiment, a method of using a work station is disclosed comprising the acts of positioning at least one keyboard section in a first orientation such that the palm of the user, when positioned on the surface of the keyboard section faces downwardly towards the floor, and manipulating the keys on the keyboard section. Further, the method comprises the acts of positioning the at least one keyboard section in a second orientation, wherein the palm of the user, when positioned on the surface of the keyboard section, faces inwardly toward the user's body, and manipulating the keys on the keyboard section.

The work station and method of using the work station of the disclosed embodiments is moveable into first and second ergonomic typing orientations that permit the user to type conventionally on a keyboard or, alternatively, type with the user's arms extending downwardly along the sides of the user. Advantageously, both typing orientations enable users to type in orientations that maintain the shoulders and arms in natural, comfortable positions. As a result, significant stress is relieved from the tendons and nerves within the arms and shoulders which, in turn, decreases the possibility of developing debilitating nerve and tendon conditions. These and other objects and advantages will become more fully apparent from the following description taken in conjunction with the accompanying drawings.

DETAILED DESCRIPTION OF THE INVENTION

Figure 1:
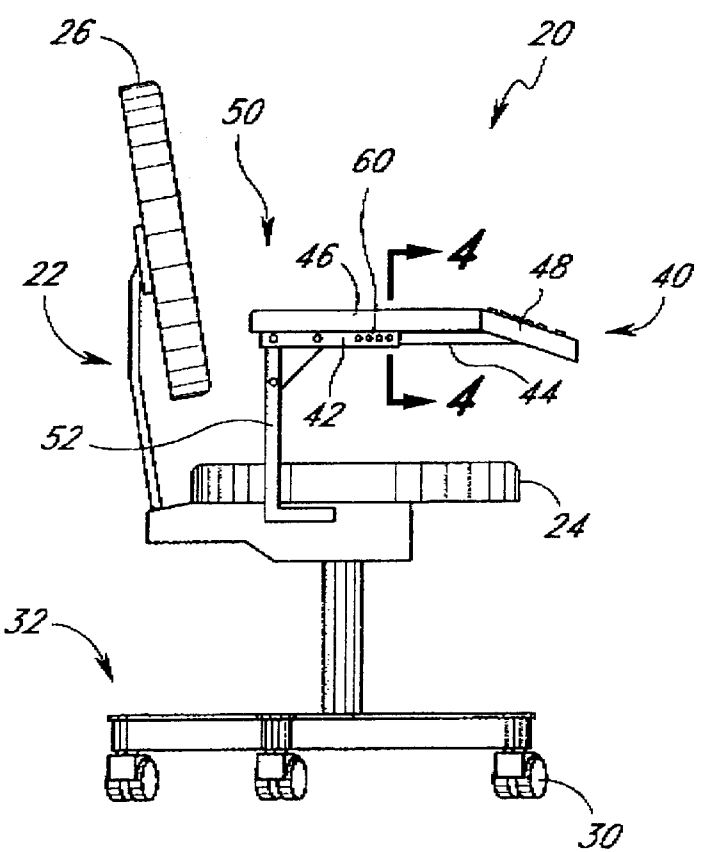
FIG. 1 is a side elevational view of the ergonomically integrated seat and work station of the invention in a first position.

Reference will now be made to the drawings wherein like numerals refer to like parts throughout. FIG. 1 illustrates an ergonomically integrated seat and work station 20 which, in the illustrated embodiment, is comprised generally of a chair 22, a pivoting keyboard arm support assembly 40 and a keyboard 44. In this embodiment, the chair 22 has a planar seat 24 connected to a back support 26. The seat 24 is supported by a rolling assembly 32 wherein the rollers 30 are in physical contact with the floor.

It will be understood by one of ordinary skill in the art that the chair 22 can have any of a number of alternative configurations known in the art. For example, the chair may not have a back support. Further, the seat may not necessarily be planar. In addition, the chair can be constructed without rollers. Additionally, the legs of the chair may be a single post, multiple legs or other constructions well known in the art. Moreover, it will be appreciated from the following description that the illustrated embodiment can be adapted for use with other work stations, including work stations in which the user is not in a sitting position, without departing from the present invention.

Figure 8:
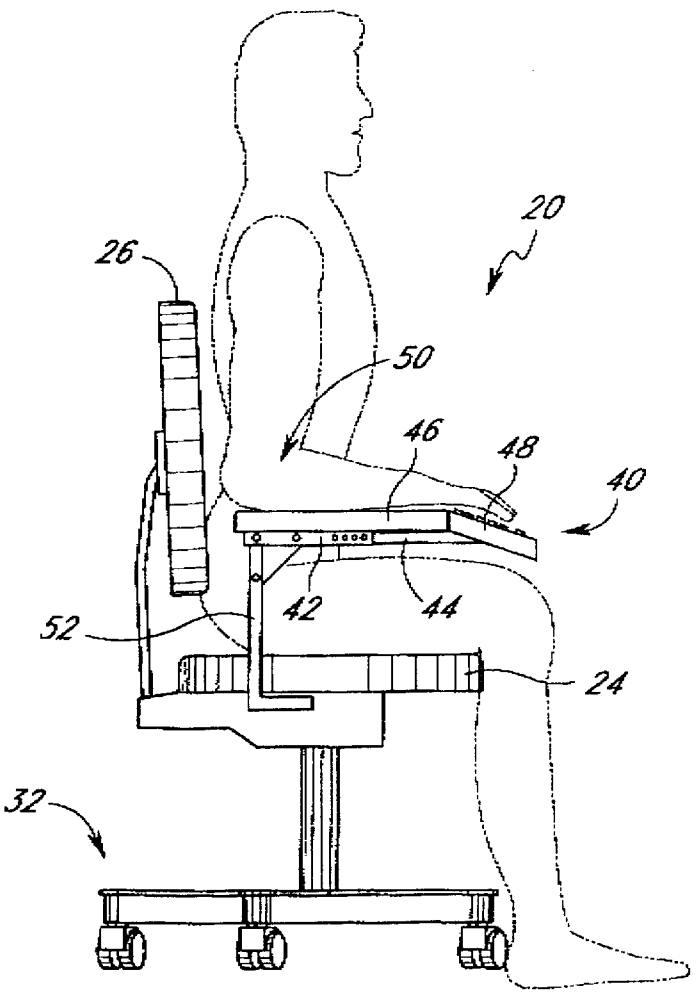
FIG. 8 is a side elevational view of the ergonomically integrated seat and work stat on FIG. 1, in use by a person shown in phantom.

As illustrated in FIG. 1, the work station 20 includes a keyboard 44 that is attached to an arm support assembly 40 that is, in turn, attached to a first end of a vertical support structure 52. The vertical support structure 52 is, in turn, attached at a second end to the underside of the seat 24 in a well known manner. In a first orientation, illustrated in FIG. 1, the upper arm support assembly 51 is positioned so as to extend outwardly in a direction that is generally parallel to the plane of the seat 24 and the floor with the keyboard 48 oriented such that the keys on the keyboard 48 are also generally parallel to the plane of the seat 24 and the floor. In this orientation, the user can type on the keyboard 48 in the traditional manner as is shown in FIG. 8.

Figure 2:
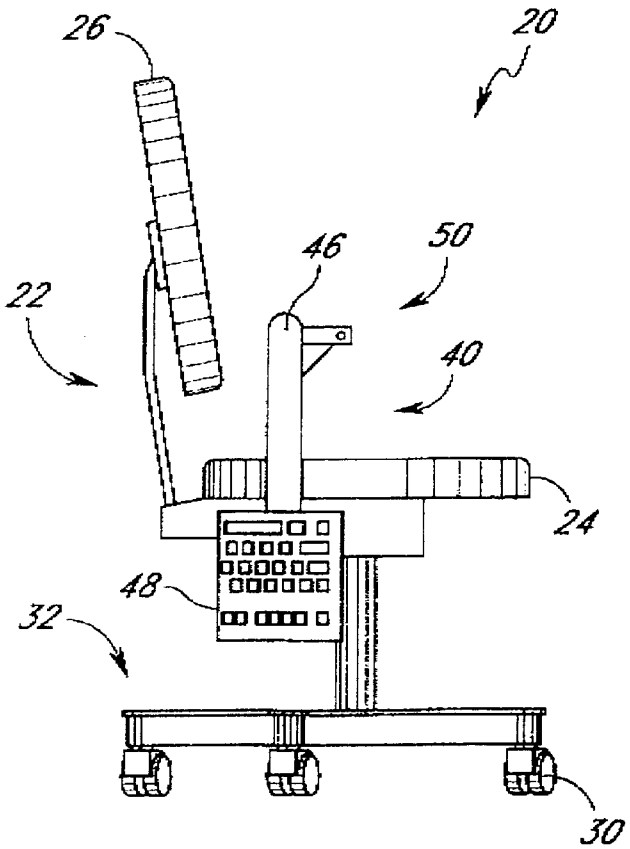
FIG. 2 is a side elevational view of the ergonomically integrated seat and work station of the invention in a second position.

Referring to FIG. 2, the work station 20, having the same structural components shown in FIG. 1, is illustrated in a second typing orientation. In this orientation, the upper arm support assembly 51, including the keyboard 48, extends downward from the top of the vertical support 52 in parallel with the vertical support 52 such that the typing surface of the keyboard 48 is perpendicular to the floor and parallel to the vertical support 52. Moreover, the keys 49 of the keyboard 48 face outwardly from the side of the work station 20. The vertical support 52 and the upper arm support assembly 51 are configured so as to allow the user to move the upper arm support assembly 51 between the two orientations in a manner that will be described in greater detail hereinbelow.

Figure 6:
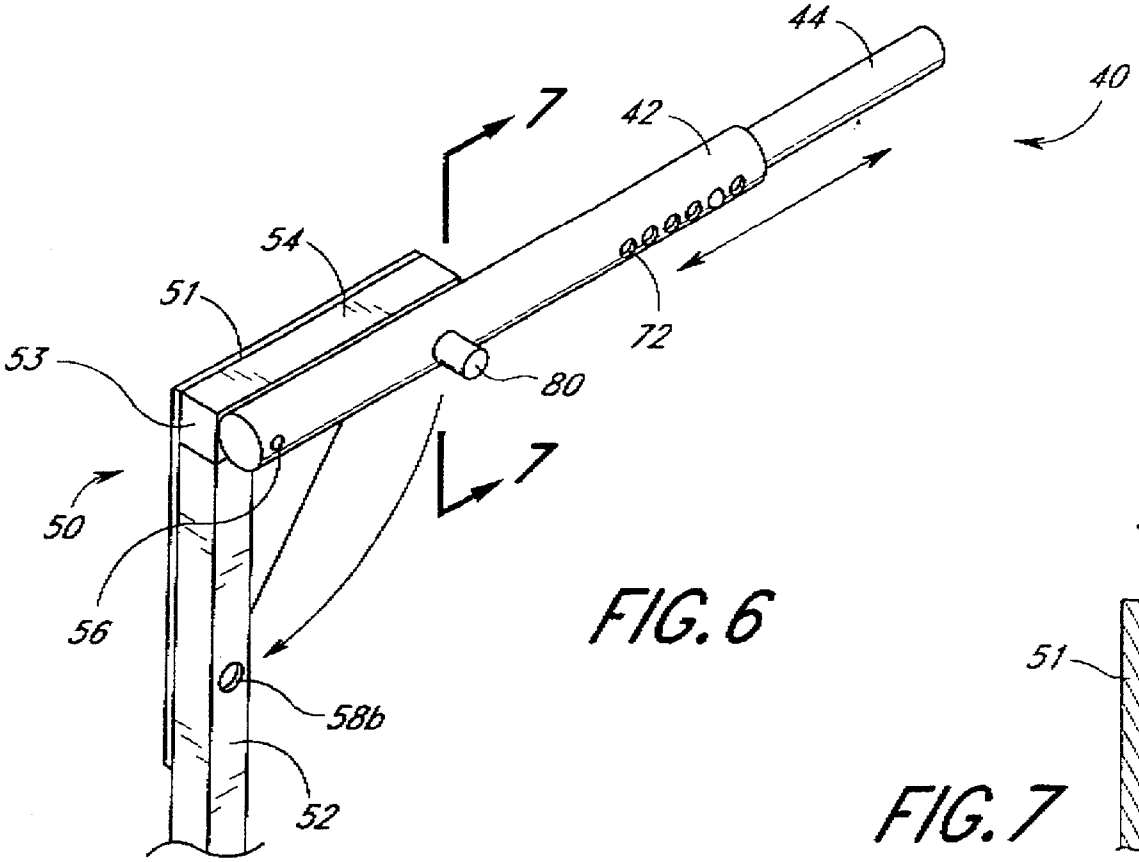
FIG. 6 is a perspective view of the pivot mechanism and support assembly of FIG. 1.

In particular, as shown in FIG. 6, the upper arm support assembly 51 includes a horizontal support structure 54. In the illustrated embodiment, an upper end of the vertical support 52 and horizontal support 54 are connected to form a generally right angle. The lower end of the vertical support 52 is attached to the underside of the seat 24, by screws, bolts or other suitable attachment means, to rigidly secure the vertical support 52 in the vertical orientation shown in FIG. 1. The vertical support 52 may be attached to the seat 24 directly or by a bracket (not shown) that is bolted to both the vertical support 52 and the seat 24.

FIG. 6 also illustrates the arm support assembly 40, without the arm rest 46 and keyboard 48 for clarity, that is pivotally attached to horizontal support 51. Specifically, a pivot mechanism 50 permits the arm support assembly 40 to be moved between the two typing orientations shown in FIGS. 1 and 2. In particular, the support assembly 40 includes a receiving rod 42 which is pivotally mounted to a junction 53 between the vertical support 52 and the horizontal support 54 at a pivot point 56 by a bolt, pin or other suitable pivot means that extends through the receiving rod 42 and the junction 53. Though secure, the bolt, pin or other pivot means is sufficiently loose to permit the receiving rod 42 to be raised and lowered with minimal resistance. At a point on the receiving rod 42, a pull pin 80, in turn, is mounted to the receiving rod 42 and, as will be discussed in greater detail below, a pull pin locking mechanism 80 permits the upper arm support assembly 40 to be securely locked in either the first or second typing orientation.

Figure 7:
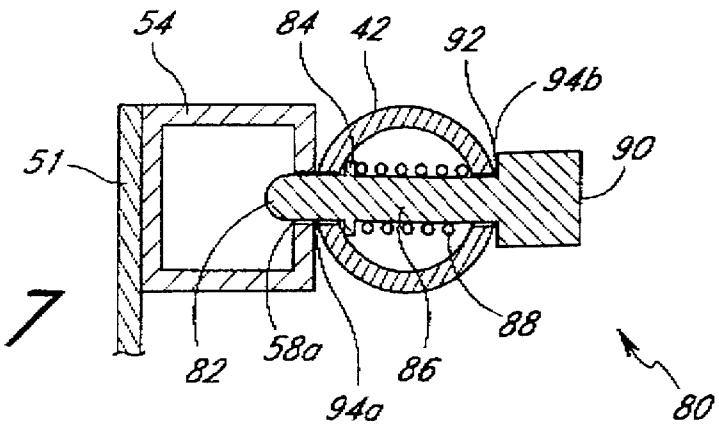
FIG. 7 is a cross-sectional view of the pivot mechanism securely engaged with the arm support assembly of FIG. 6, taken along line 7—7.

As indicated above, the arm support assembly 40 and, specifically the receiving rod 42, is moveable between the first and second typing orientations. To move the receiving rod 42 from the first orientation shown in FIGS. 1 and 6 to the second typing orientation shown in FIG. 2, the pull pin 80, discussed in greater detail below in reference to FIG. 7, is disengaged, and the receiving rod 42 is swung down while pivoting about the pivot point 56. To securely engage the receiving rod 42 to the vertical support 52, the receiving rod 42 is positioned in line with the vertical support 52 and the pull pin 80 is securely engaged with the vertical support 52. As a result, the receiving rod 42 is securely engaged with the vertical support 52 in a second typing orientation.

The pull pin mechanism 80 will now be described in reference to FIG. 7. In particular, FIG. 7 illustrates the pull pin mechanism 80 engaged with the horizontal support 54. The horizontal support 54 has a first hole 58*a* for receiving a pull pin 80. Engaged with the horizontal support 54 by the pull pin 80 is the receiving rod 42. First and second pre-cut apertures 94*a*, 94*b* are positioned on opposite sides of the receiving rod 42 aligned with each other. The pull pin mechanism 80 is positioned through the receiving rod 42. The pull pin mechanism 80 is comprised of an elongate pin 86 having a proximal and a distal end. The proximal end is a rounded tip 82, and the distal end is an integral tab 90. Positioned about the elongate pin 86 is a resilient member 88. Preferably, the resilient member 88 is positioned entirely within the receiving rod 42. Generally an annular ring 84 is affixed to the elongate pin 86 near the rounded tip 82 of the elongate pin 86, so as to extend outwardly about the pin 86. As shown in FIG. 7, the annular ring 84 is within the receiving rod 42 while the rounded tip 82 protrudes through the first aperture 94*a* and first hole 58*a* so as to engage the receiving rod 92 with the horizontal support 54 in the first orientation shown in FIG. 1.

When the support assembly 40 is in the locked position shown in FIG. 7, the resilient member 88 surrounding the elongate portion 86 of the pin 80 is substantially decompressed. The resilient member 88 applies force to the annular ring 84 on the elongate portion 86 which, in turn, forces the rounded tip 82 through the aperture 96 on the receiving rod 42 and further through the first hole 58*a* on the horizontal support 54. To disengage the pull pin 80 from the horizontal support 54 and thus unlock the support assembly 40 from the first typing orientation, the tab 90 of the pin 80 is pulled outward causing the annular ring 84 to contact and compress the resilient member 88. The pull pin 80 is pulled outward from the receiving rod 42 a distance sufficient so that the rounded tip 82 clears the side of the horizontal support 54 and is withdrawn from the first hole 58*a*. The receiving rod 42 swings down while pivoting at the pivot point 56. To securely engage the receiving rod 42 with the vertical support 52, the pull pin 80 is pulled outward from the receiving rod 42 to clear the side of the vertical support 52 and the pull pin 80 is released into a second hole 58*b* (FIG. 6) in the vertical support 52. Once the pull pin 80 is engaged with the vertical support structure 52, the support assembly 40 is locked in the second typing orientation. Hence, the pull pin mechanism 80 can be engaged with the holes 58*a* and 58*b* to selectively lock the receiving rod 42 of the support assembly 40 in either the first or second orientations.

Figure 4:
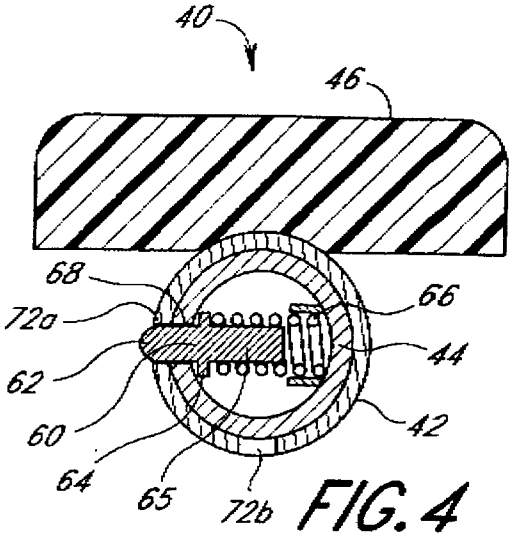
FIG. 4 is a cross-sectional view of the arm rest and arm support assembly of FIG. 1, taken along line 4—4.
Figure 5:
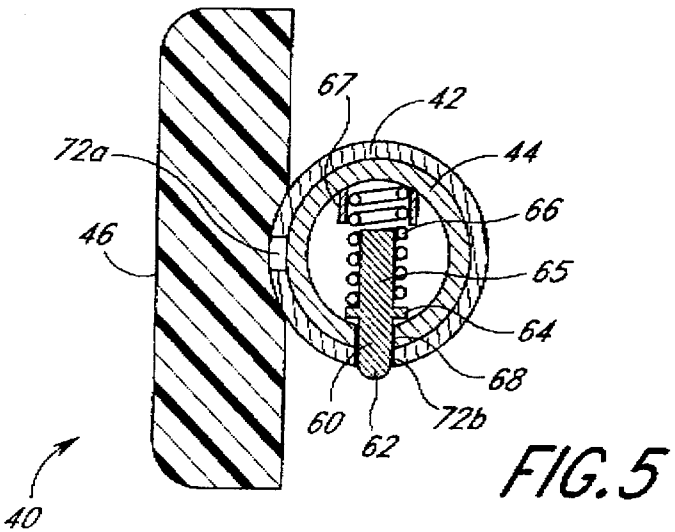
FIG. 5 is a cross-sectional view of the arm rest and arm support assembly of FIG. 1 shown rotated outwardly.

As illustrated in FIGS. 4–6, the inner rod 44, to which the keyboard 48 is attached, can be rotated outwardly about the axis of the support assembly 40 such that the palm of the user's hand faces inward when positioned on the keyboard 48 with the support assembly 40 and the keyboard 48 in the second orientation. In particular, as shown in FIGS. 1 and 6, the inner rod 44 is positioned inside and extends outward from the front end of the receiving rod 42. A keyboard 48, in turn, is fixedly connected to the outer end of the inner rod 44 in a manner well known in the art. The keyboard 48 may be connected to the inner rod 44 by any suitable attachment means. For example, the inner rod 44 may be bolted to the underside of the keyboard 48. Alternatively, the inner rod 44 may be welded or bolted to a tray that is configured to receive a keyboard 48. The tray, in turn, may be attached in any suitable manner to the keyboard 48 to permit the keyboard 48 to remain in a fixed position in both the first and second typing orientations. Further, in this embodiment, an arm rest 46 is mounted on the top surface of the inner rod 44 in a manner described in more detail below.

As illustrated in FIG. 1, the keyboards 48*a*, 48*b* are connected to the inner rods 44*a*, 44*b* respectively in the manner described above. Together, the keyboards are comprised of the standard letter, number and function keys 49 of a common QWERTY computer keyboard. Separating the keyboards 48 into two halves permits the user's arms to be positioned in a more comfortable typing orientation. Whereas standard flat keyboards require the user's arms to bend or extend inwardly so that the hands can be placed on the keyboard, the bifurcated keyboard 48 allows the arms to remain substantially straight when extended outward. Because the arms are straight, less medial stress is placed on the arm tendons and nerves thereby decreasing the risk of developing debilitating tendon and nerve conditions.

It will be understood by one of ordinary skill in the art that the keyboards 48*a*, 48*b* may be comprised of any number of combinations of keys. For example, the keyboards 48 may have keys representing every letter of the alphabet. Alternatively, the keys may contain alphabetical keys as well as a separate keypad comprised of numbers. In a further embodiment, the keyboard may contain digits representing symbols, for example, those used by court transcribers. In even a further embodiment, the keypad may be comprised of irregular number, letter, or symbol combinations prearranged for use with specific computer hardware or software applications.

Figure 3:
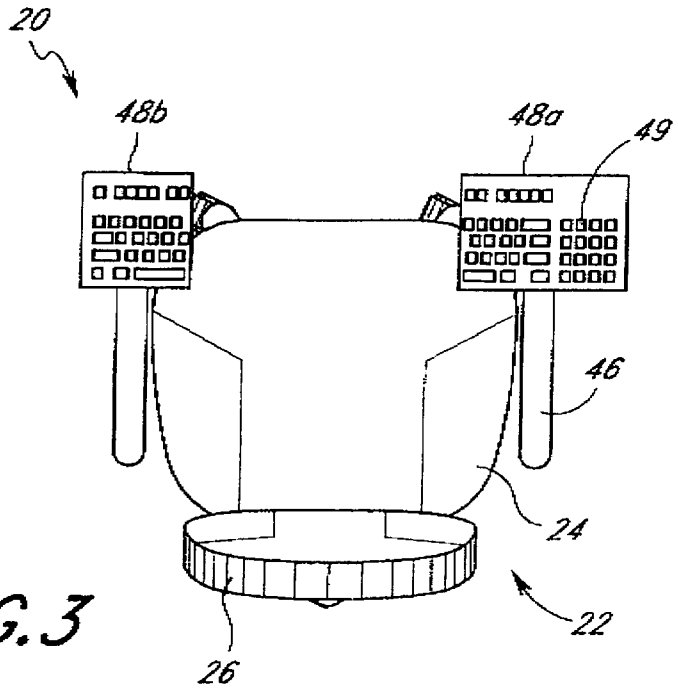
FIG. 3 is a top plan view of the ergonomically integrated seat and work station of FIG. 1.

It will also be understood that the work station 20 may be comprised of only one keyboard 48. For example, in one embodiment a numbered accounting keypad may be positioned on one side of the work station 20, while the other side of the work station 20 is devoid of a keyboard 48 or support assembly 40. It will further be understood that the keyboard 48 need not be symmetrically positioned with respect to the arm support assembly 40. That is, the keyboards 48*a*, 48*b* may be oriented in a plane parallel to the floor, as shown in FIG. 3. Alternatively, the keyboards 48*a*, 48*b* may be rotated from the plane parallel to the floor to provide a more ergonomic orientation. Further, the keyboards 48*a*, 48*b* may be elevated in the rear or in front according to the user's preferences. Additionally, alternative embodiments may provide adjusting means to move the keyboards 48*a*, 48*b* to these various positions.

Desirably, an armrest 46 is securely attached to the inner rod 44 by any suitable attachment means such as screws, bolts or adhesive. For example, bolts or screws may extend through the inner rod 44 into the armrest 46. Alternatively, a strong adhesive may be applied to the inner rod 44 and the armrest 46 and both components firmly pressed together to firmly secure them to each other. In another embodiment, the arm support assembly 40 may not contain an armrest 46, instead relying on the keyboards 48 to provide support to the user's hands.

Referring now to FIGS. 4 and 5, the mechanism by which the keyboards 48 rotate about the axis defined by the arm support assembly 40 is illustrated. This mechanism allows for the keyboard 48 to be secured in one of two rotational orientations.

The locking mechanism 60 is positioned inside of the inner rod 44 and is characterized by a cylindrical elongated pin 65 having a rounded outward end or top 62. An integral annular ring 64 is affixed to the elongated pin 65, generally near the rounded top 62, which extends outwardly from an opening in the inner rod 44 and the receiving rod 42. The pin 65 is positioned within a resilient member 66 that is also positioned in the inner rod 44 such that the annular ring 64 is urged towards the inner wall of the inner rod 44 so as to urge the rounded top 62 of the pin 65 out into the opening 68 of the inner rod 44. The diameter of the pin 65 at the annular ring 64 is at least equal to the diameter of the resilient member 66. The diameter of the remainder of the pin 65 is less than the diameter of the resilient member 66. Two spaced-apart flanges 67 protrude outwardly from the interior surface of the inner rod 44 parallel to each other. The resilient member 66 is positioned between the flanges 67 within the inner rod 44 thereby maintaining the resilient member 66 in a predetermined position within the inner rod 44. Multiple spaced-apart preformed apertures 72 may be positioned in-line along the length of the receiving rod 42.

With the resilient member 66 substantially decompressed, the rounded top 62 of the pin 65 protrudes through an aperture 68 in the inner rod 44. The pin 65 further protrudes through a corresponding aperture 72 in the receiving rod 42. By protruding through the inner rod 44 and receiving rod 42, the pin 65 securely engages the inner rod 44 to the receiving rod 42 in a desired rotational orientation.

FIG. 5 illustrates the arm support assembly 40 in a second rotational orientation. Here the rounded top 62 of the pin 65 protrudes through the same aperture 68 in the inner rod 44 and through a second aperture 72 in the receiving rod 42. In one embodiment, the second aperture 72*b* in the receiving rod 42 is positioned at a 90° angle with respect to the first aperture 72*a* thereby allowing the keyboard 48 to be positioned in one of two rotational orientations.

Referring again to FIG. 4, in order to rotate the armrest support assembly 40 outward, the rounded tip 62 of the pin 65 is depressed by a user. The force applied on the rounded tip 62 causes the annular ring 64 to bear down on the resilient member 66. As a result, the resilient member 66 compresses thereby allowing the rounded tip 62 to move inwardly a sufficient amount to substantially exit from the first aperture 72*a* of the receiving rod 42. With the pin 65 disengaged from the aperture 72*a*, the integral armrest 46, inner rod 44 and keyboard 48 may be rotated. As best seen in FIG. 5, when the inner rod 44, and thus the keyboard 48, is fully rotated 90°, the rounded tip 62 of the pin 65 comes into communication with the second receiving rod aperture 72*b* thereby permitting the resilient member 66 to decompress. The force of the decompression, in turn, causes the resilient member 66 to bear against the annular ring 64 thereby forcing the rounded tip 62 through the second receiving arm aperture 72*b*. As a result, the pin 65, and therefore the arm rest support assembly 40, securely engages the receiving rod 42 in a second rotational orientation.

The inner rod 44 is also telescopically adjustable within the receiving rod 42, as shown in FIG. 6. That is, the arm support assembly 40 may be lengthened or shortened depending on physical characteristics of the user. As shown in FIGS. 4 and 5, the inner rod 44 is securely engaged to the receiving rod 42 by the pin mechanism 60. The pin 65 and a resilient member 66 are positioned within the inner rod 44 perpendicular to the longitudinal axis of the inner rod 44. As illustrated in FIG. 4, in a first position, the pin 60 is positioned within a resilient member 66 such as a spring. The precut apertures 72 on the receiving rod 42 are of a sufficient diameter to permit the rounded top 62 of the pin 60 to protrude through the aperture 72 and securely engage the receiving rod 42. This structure permits the inner rod 44 to be telescopically moveable within the receiving rod 44.

In use, the pin mechanism 60 (FIGS. 3 and 4) is depressed, thereby permitting the inner rod 44 to slide within the receiving rod 42. The inner rod 44 is then locked into the desired position by the secure engagement of the pin 60 to one of several apertures 72 positioned along the length of the receiving rod 42. By adjusting the length of the inner rod 44, the arm support assembly 40 can be quickly customized to fit the arms of a particular user.

Figure 9:
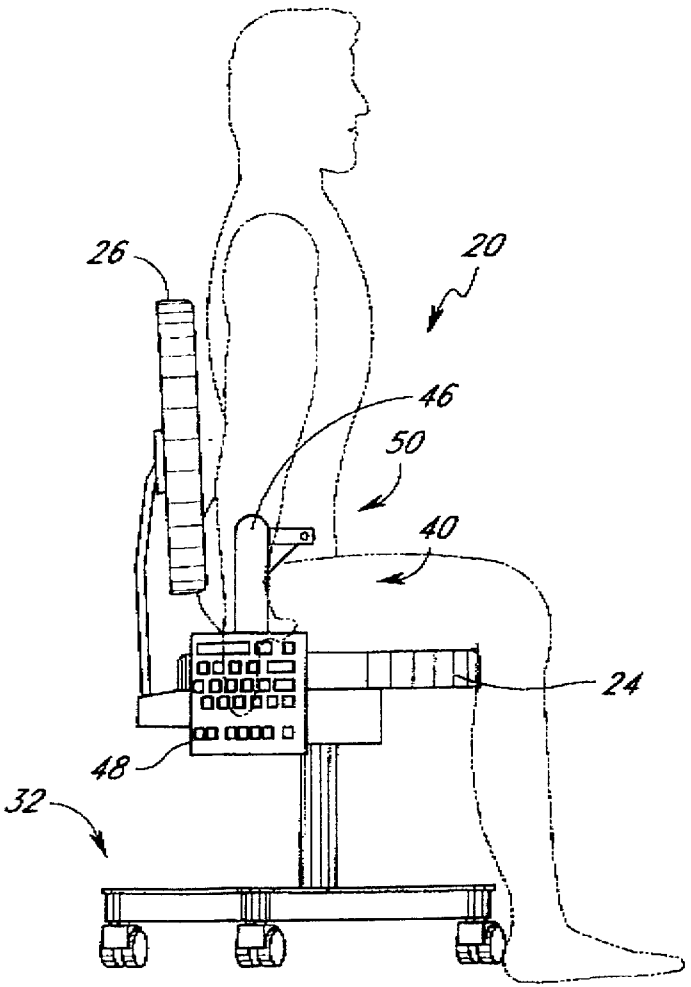
FIG. 9 is a side elevational view of the ergonomically integrated seat and work station of FIG. 2, in use by a person shown in phantom.

Referring to FIGS. 8 and 9, the integrated chair and ergonomic keyboard work station 20 operates in the following manner. In use, the user can type in a first position whereby the user's forearms are positioned on the armrest 46 and extend horizontally outward from the user's torso so that the hands engage the keyboards 48 with the user's palms facing downward in the manner shown in FIG. 8. To move the keyboard 48 from the first typing position to the second typing position, where the user's arms extend generally downward with their hands engaging with the keyboard such that the user's palms face inward in the manner shown in FIG. 9, the armrest assembly 46 is both rotated about the axis defined by the support assembly 40 and is pivoted downward about the pivot point 56 (FIG. 6) in the manner described above. To move the arm support assembly 40 between the horizontal and the vertical typing positions, the user first disengages the locking mechanism 60 which locks the inner rod 44 in the first rotational position about the axis defined by the support assembly wherein the keyboard is positioned so as to be parallel with the plane of the seat 24 of the chair 22. The user then rotates the keyboard so that it is in the second rotational position such that the plane of the keyboard 48 is perpendicular to the plane of the seat. The user then disengages the pull pin 80 from the horizontal support so as to move the support assembly 40 from the horizontal orientation to the vertical orientation. The user then manipulates the pull pin 80 so that it engages with the opening 58*b* on the vertical support in the manner shown in FIG. 2 thereby securing the support assembly 40 on the vertical orientation. The user simply reverses this process to return the arm support assembly 40 to the horizontal typing position. In this way, the user can adjust the position of the arm support to facilitate typing in one of the two positions.

In particular, in a first position a user sits in the chair 22 while the user's arms extend outward from the body. The user's forearms, in turn, rest on the armrest 46 while the hands are placed on the bifurcated keyboards 48. Thus, a user may type in this first orientation. In a second typing orientation, the inner rod 44 and keyboard 48 are rotated outward and then lowered downward to a generally vertical position. As best illustrated in FIG. 9, the user's arms hang generally along the sides of the body with the user's hands resting on the keyboard 48. In this typing position, the thumbs of the user generally point forward.

In this second position, the user can type on the keyboards 48 in a comfortable, natural position. Peoples' arms naturally hang at their sides while standing or sitting. In a natural hanging position, the hands are generally oriented such that the thumbs point forward while the palms face inward. As shown in FIG. 9, the work station 20 generally mimics the orientation of a user's hands when hanging in a relaxed, natural position. Advantageously, the user can type while placing minimal stress on the tendons and nerves of the user's hands and arms.

In this manner, the work station 20 is moveable into first and second ergonomic typing orientations that permit the user to type conventionally on a bifurcated keyboard 48 or, alternatively, type in a second orientation with the user's arms extending down the sides of the chair 22. Advantageously, both typing orientations enable users to type in orientations that maintain the shoulders and arms in natural, comfortable positions. As a result, significant stress is relieved from the tendons and nerves within the arms and shoulders which, in turn, decreases the possibility of developing debilitating nerve and tendon conditions.

Although the foregoing description of the preferred embodiment of the present invention has shown, described and pointed out the fundamental novel features of the invention, it will be understood that various omissions, substitutions and changes in the form of the detail of the apparatus as illustrated as well as the uses thereof, may be made by those skilled in the art without departing from the spirit of the present invention. Consequently, the scope of the present invention should not be limited to the foregoing discussion, but should be defined by the claims.

What is claimed is:

1. An ergonomic work station, comprising:

a chair configured to be positioned on a floor, said chair comprising a seat configured to receive a user in a sitting position and a back support connected to said seat;

at least one keyboard section having a plurality of keys;

at least one support assembly connected to said keyboard section;

at least one support structure connected to the chair at a first location on said structure, and connected to the support assembly at a second location on said structure;

wherein the location of attachment of the support assembly and the support structure defines a pivot, about which said support assembly is pivotably movable, said pivot being configured to enable said support assembly to move between a first orientation, wherein the keyboard section extends outward from the chair in a plane generally parallel to the floor and said keyboard section is a first distance from a plane substantially encompassing the back support, and a second orientation, wherein said keyboard section extends downward in a plane generally perpendicular to the floor and said keyboard section is a second distance which is less than the first distance from the plane substantially encompassing the back support; and p1 wherein the chair and the support assembly are so dimensioned that when the keyboard section is in the first orientation, and a user is in a selected position in the chair, and when the user's forearm extends outward from the body in a direction substantially parallel to the floor, the user's hand can engage the keys of said keyboard section in a typing configuration, and when said keyboard section is in said second orientation, and the user is in said selected position in said chair, and when the user's arm extends downward along the side of the body in a direction substantially perpendicular to the floor the user's hand can engage said keys of said keyboard section substantially in said typing configuration.

2. The work station of claim 1, wherein said chair and support assembly are so dimensioned that when said support assembly is in said first orientation, and a user is positioned in said chair with the user's hand engaging the keyboard section, the user's arm extends outward from the body in a direction substantially parallel to the floor such that the palm of the hand engaging the keyboard section generally faces the floor.

3. The work station of claim 1, wherein said work station is comprised of two support assemblies attached to two keyboard sections, said two keyboard sections spaced apart from each other at a distance generally equal to the width of said chair such that, when the user is sitting in said chair with the user's hands engaging the keyboard sections, the user's arms extend outwardly from the user's body in a direction generally parallel to the floor.

4. The work station of claim 1, wherein said work station is comprised of two support assemblies attached to two keyboard sections, said two keyboard sections spaced apart from each other a distance generally equal to the width of said chair such that, when the user is sitting in said chair with the user's hands engaging the keyboard sections the user's arms extend outwardly from the body in a direction generally parallel to the floor, and said two keyboard sections being two bifurcated sections of a standard keyboard.

5. The work station of claim 1, wherein said work station is comprised of two keyboard sections that are independently movable such that a user may operate one keyboard section in said first orientation while simultaneously operating the other keyboard section in said second orientation.

6. The work station of claim 1, wherein said chair has a generally planar seat dimensioned to receive a user in generally conventional sitting orientation with the legs of the user extending towards the floor.

7. The work station of claim 1, wherein said chair is fitted with rollers such that a user can operate said work station in various positions in a work space without leaving said work station.

8. The work station of claim 1, wherein said support assembly is comprised of a receiving rod and an inner rod, said inner rod positioned within said receiving rod, said inner rod telescopically moveable within said receiving rod such that said inner rod can extend outwardly from said receiving rod or extend within said receiving rod to accommodate the physical characteristics and arm length of a particular user when the user is positioned within said chair.

9. The work station of claim 8, wherein said outer rod defines a longitudinal axis along the length of said outer rod, and said inner rod is moveable within said outer rod about said longitudinal axis of said outer rod and said keyboard section is attached to said inner rod so as to be adjustable along said longitudinal axis.

10. The work station of claim 8, wherein said inner rod is secured to said receiving rod by a spring-actuated pin mechanism so as to enable a user to quickly adjust the length of said inner rod with respect to said receiving rod to accommodate the physical characteristics and arm length of the user when sitting in said chair, and adjust the plane in which said keyboard section is maintained.

11. The work station of claim 8, wherein said inner rod is fitted with an arm rest to comfortably support the weight of a user's arm when said support assembly is in said first orientation and the user is positioned in said chair, and the user's arm extends outward from the body in a direction substantially parallel to the floor with the user's hand engaging the keyboard such that the user's palm generally faces the floor, and when said support assembly is in said second orientation and a user is positioned in said chair, and the user's arm extends downward along the side of the body in a direction substantially perpendicular to the floor with the user's hand engaging said keyboard section such that the user's palm generally faces toward the side of the user's body.

12. The work station of claim 1, wherein said support assembly is further comprised of a locking mechanism, said locking mechanism configured to enable said support assembly to be locked in either said first orientation or said second orientation.

13. The work station of claim 12, wherein said locking mechanism is a spring actuated pin mechanism configured to permit a user to quickly engage and disengage said mechanism and move said support assembly between a first and second orientation.

14. A typing chair positionable on a floor, comprising:

a substantially planar seat configured to receive a user in a sitting position;

a back support connected to said seat;

at least one support assembly comprising an inner rod with a first and a second end, said second end rotatably connected within said support assembly;

at least one keyboard section having a plurality of keys, said keyboard section connected to the first end of the inner rod of the support assembly, said inner rod being configured to enable said keyboard section to move between a first orientation such that the keyboard section is in a plane generally parallel to the floor and a second orientation such that the keyboard section is in a plane generally perpendicular to the floor;

at least one support structure connected to the chair at a first location on said structure, and connected to the support assembly at a second location on said structure;

wherein the location of attachment of the support assembly and the support structure defines a pivot, about which said support assembly is pivotably movable, said pivot being configured to enable said support assembly to move between a first orientation and a second orientation such that when said support assembly is in said first orientation, the keyboard section is a first distance from a plane substantially encompassing the back support and when said support assembly is in the second orientation, said keyboard section is a second distance which is less than said first distance from said plane substantially encompassing the back support; and wherein the chair and the support assembly are so dimensioned that when the support assembly and the keyboard section are in the first orientations, and a user is in a selected position in said chair, and when the user's forearm extends outward from the body in a direction substantially parallel to the floor, the user's hand can engage the keys of said keyboard section in a typing configuration and when said support assembly and said keyboard section are in the second orientations, and a user is in said selected position in said chair, and when the user's arm extends downward along the side of the body in a direction substantially perpendicular to the floor the user's hand can engage said keys of said keyboard section substantially in said typing configuration.

15. The chair of claim 14, wherein said chair is comprised of two support assemblies attached to two keyboard sections, said two keyboard sections spaced apart from each other a distance generally equal to the width of said seat of said chair such that, when the user is sitting in said chair with the user's hands engaging the keyboard sections, the user's arms extend outwardly from the body in a generally perpendicular direction from the user's body.

16. The chair of claim 14, wherein said chair is comprised of two support assemblies attached to two keyboard sections, said two keyboard sections spaced apart from each other a distance generally equal to the width of said chair such that, when the user is sitting in said chair with the user's hands engaging the keyboard sections, the user's arms extend outwardly from the body in a generally perpendicular direction from the user's body, and said two keyboard sections together comprising a common keyboard.

17. The chair of claim 14, wherein said chair is comprised of two keyboard sections that are independently movable such that a user may operate one keyboard section in said first orientation while simultaneously operating the other keyboard section said second orientation.

18. The chair of claim 14, wherein said chair is fitted with rollers such that a user can operate said work station in various positions in a work space without leaving said work station.

19. The chair of claim 14, wherein the support assembly further comprises a receiving rod, the inner rod positioned within said receiving rod, said inner rod telescopically moveable within said receiving rod such that said inner rod can extend outwardly from said receiving rod or extend within said receiving rod to accommodate the physical characteristics and arm length of a particular user when the user is positioned within said chair.

20. The chair of claim 19, wherein said outer rod defines a longitudinal axis along the length of said outer rod, and said inner rod is moveable within said outer rod about said longitudinal axis of said outer rod and said keyboard section is attached to said inner rod so as to be adjustable along said longitudinal axis.

21. The chair of claim 19, wherein said inner rod is secured to said receiving rod by a spring-actuated pin mechanism so as to enable a user to quickly adjust the length of said inner rod with respect to said receiving rod to accommodate the physical characteristics and arm length of the user when sitting in said chair and adjust the plane in which said keyboard section is maintained.

22. The chair of claim 19, wherein the inner rod is fitted with an armrest to support the weight of a user's arm when the support assembly is in the first orientation and the user is positioned in said chair, and the user's arm extends outward from the body in a direction substantially parallel to the floor with the user's hand positioned on the surface of the keyboard section such that the user's palm generally faces the floor.

23. The chair of claim 14, wherein said support assembly is further comprised of a locking mechanism that permits said support assembly to be locked in either said first orientation or said second orientation.

24. The chair of claim 23, wherein said locking mechanism is a spring actuated pin mechanism configured to permit a user to quickly engage and disengage said mechanism and move said support assembly between a first and second orientation.

25. A method of using a workstation comprising the acts of:

positioning at least one keyboard section in a first orientation, wherein the keyboard section is positioned so as to extend generally horizontally outward and forward from the torso of a user positioned at a selected location in the workstation, and wherein the keyboard is a first distance from a back section of the workstation, with the keys facing upwards so as to be contacted by a user in a typing configuration when a user is using the workstation;

manipulating the keys on the at least one keyboard section;

positioning the at least one keyboard section in a second orientation, wherein the at least one keyboard section is positioned so as to extend generally vertically downward from and along the side of the torso of the user who is positioned at the selected location, and wherein, in the second orientation, the keyboard is a second distance which is less than the first distance from the back section of the workstation, with the keys facing away from the user; and manipulating the keys with the user's fingers in the typing configuration on the at least one keyboard section and with the user's palms opposed to one another so as to contact the keys with the user's fingers, the user's forearms extending downward along the side of the body in a direction substantially perpendicular to the floor.

26. The method of claim 25, wherein the act of positioning the at least one keyboard section in a first orientation comprises positioning a first keyboard section that is pivotally attached to a frame of the workstation so as to extend horizontally outward from the user while the user is sitting in a chair.

27. The method of claim 26, wherein the act of positioning the at least one keyboard section in a first orientation further comprises positioning a second keyboard section, that is pivotally attached to a frame of the workstation so as to extend horizontally outward from the user while the user is sitting in the chair, wherein the first and the second keyboard sections are spaced apart from each other in the first orientation a distance substantially equal to the width of the user's torso and wherein the first and second keyboard sections comprise a bifurcated [QWERTY] keyboard.

28. The method of claim 26, wherein the act of positioning the at least one keyboard section into the second orientation comprises pivoting a support member that connects the at least one keyboard section to the workstation from the first orientation so that the at least one keyboard section is moved from its horizontal orientation to its vertical orientation.

29. The method of claim 28, wherein the act of positioning the at least one keyboard section into the second orientation further comprises rotating a first member of the support member that is attached to the at least one keyboard section with respect to a second member of the support member that is attached to a body of the workstation so that the keys of the keyboard section face away from the user when the user is positioned in the workstation.

30. The method of claim 29, further comprising the acts of:

securing the at least one keyboard section in the first orientation; and securing the at least one keyboard section in the second orientation.

31. The method of claim 30, wherein the act of securing the at least one keyboard section in the first orientation comprises engaging a first pin, that is coupled to the support member, to a first member of the workstation so that the first pin retains the support member and the at least one keyboard section in the first orientation.

32. The method of claim 31, wherein the act of securing the at least one keyboard section in the first orientation comprises engaging a second pin that is mounted on the first member of the support member with a second member of the support member so as to retain the keyboard section in a first orientation with respect to the second member of the support member.

33. The method of claim 32, wherein the act of securing the at least one keyboard section in the second orientation comprises engaging the first pin with a second member so as to retain the at least one keyboard section in its vertical orientation.

34. The method of claim 33, wherein the act of securing the at least one keyboard section in the second orientation comprises engaging the second pin with a second opening in the second member so that the at least one keyboard section is rotated 90 degrees with respect to the second member from the first orientation.

35. A method of using a workstation comprising the acts of:

positioning first and second keyboard sections in a first orientation, wherein the first and second keyboard sections are positioned so as to extend generally horizontally outward and forward from the torso of a user positioned at a selected location in the workstation, wherein the keyboard is a first distance from a back section of the workstation, with the keys facing upwards;

manipulating the keys on the first and second keyboard sections with the user's hands in a typing configuration on the keys;

positioning the first and second keyboard sections in a second orientation, wherein the first and second keyboard sections are positioned so as to extend generally vertically downward from and along the side of the torso of the user who is positioned at the selected location, wherein the keyboard is a second distance which is less than the first distance from the back section of the workstation, and with the keys facing away from the user; and manipulating the keys with the user's fingers on the first and second keyboard sections in the typing configuration with the user's palms opposed to one another such that, to contact the keys with the user's fingers, the user's forearms extend downward along the side of the body in a direction substantially perpendicular to the floor.

36. The method of claim 35, wherein the act of positioning the first keyboard section in the first orientation comprises positioning the first keyboard section that is pivotally attached to a frame of the workstation so as to extend horizontally outward from the user while the user is sitting in a chair; and positioning the second keyboard section in the first orientation comprises positioning the second keyboard section that is pivotally attached to a frame of the workstation so as to extend horizontally outward from the user while the user is sitting in a chair so that the first and the second keyboard sections are spaced apart from each other a distance substantially equal to the width of the user's torso.

37. The method of claim 36, wherein the act of positioning the first keyboard section into a second orientation comprises pivoting a support member that connects the first keyboard section to the workstation from the first orientation so'that the first keyboard section is moved from the horizontal orientation to the vertical orientation; and positioning the second keyboard section into a second orientation comprises pivoting a support member that connects the second keyboard section to the workstation from the first orientation so that the second keyboard section is moved from the horizontal orientation to the vertical orientation.

38. The method of claim 37, further comprising the act of securing the first keyboard section in the first orientation by engaging a first pin, that is coupled to the support member, to a first member of the workstation so that the first pin retains the support member and the first keyboard section in the first orientation; and securing the second keyboard section in the first orientation by engaging a first pin, that is coupled to the support member, to a first member of the workstation so that the first pin retains the support member and the second keyboard section in the first orientation.

39. The method of claim 38, wherein the act of securing the first keyboard section in the first orientation further comprises engaging a second pin that is mounted on the first member of the support member with the second member of the support member so as to retain the first keyboard section in a first orientation with respect to the second member of the support member; and securing the second keyboard section in the first orientation further comprises engaging a second pin that is mounted on the first member of the support member with the second member of the support member so as to retain the second keyboard section in a first orientation with respect to the second member of the support member.

40. The method of claim 39, wherein the act of securing the first keyboard section in the second orientation comprises engaging the first pin with a second member so as to retain the first keyboard section in a vertical orientation; and securing the second keyboard section in the second orientation comprises engaging the first pin with a second member so as to retain the second keyboard section in a vertical orientation.

41. The method of claim 40, wherein the act of securing the first keyboard section in the second orientation comprises engaging the second pin with a second opening in the second member so that the first keyboard section is rotated 90 degrees with respect to the second member from the first orientation; and securing the second keyboard section in the second orientation comprises engaging the second pin with a second opening in the second member so that the second keyboard section is rotated 90 degrees with respect to the second member from the first orientation.

42. The method of claim 35, wherein the act of positioning the first keyboard section into the second orientation further comprises rotating a first member of the support member that is attached to the first keyboard section with respect to the second member of the support member that is attached to the body of the workstation so that the keys of the first keyboard section face away from the user when the user is positioned in the workstation; and positioning the second keyboard section into the second orientation further comprises rotating a first member of the support member that is attached to the second keyboard section with respect to the support member that is attached to the body of the workstation so that the keys of the second keyboard section face away from the user when the user is positioned in the workstation.

43. An ergonomic work station, comprising:

means for positioning at least one keyboard section in a first orientation, wherein the keyboard section is positioned so as to extend generally horizontally outward and forward from the torso of a user positioned at a selected location in the workstation, and wherein the keyboard is a first distance from a back section of the workstation, with the keys facing upwards so as to be contacted by a user in a typing configuration when a user is using the workstation;

means for manipulating the keys on the at least one keyboard section;

means for positioning the at least one keyboard section in a second orientation, wherein the at least one keyboard section is positioned so as to extend generally vertically downward from and along the side of the torso of the user who is positioned at the selected location, and wherein, in the second orientation, the keyboard is a second distance which is less than the first distance from the back section of the workstation, with the keys facing away from the user; and means for manipulating the keys with the user's fingers in the typing configuration on the at least one keyboard section and with the user's palms opposed to one another so as to contact the keys with the user's fingers, the user's forearms extending downward along the side of the body in a direction substantially perpendicular to the floor.

* * * * *

UNITED STATES PATENT AND TRADEMARK OFFICE

CERTIFICATE OF CORRECTION

PATENT NO. : 6,237,997 B1
DATED : May 29, 2001
INVENTOR(S) : Joshua Olson

It is certified that error appears in the above-identified patent and that said Letters Patent is hereby corrected as shown below:

Column 3,
Line 56, please delete "stat" and insert therefore, -- station --.

Signed and Sealed this

Seventh Day of October, 2003

JAMES E. ROGAN
*Director of the United States Patent and Trademark Office*